US009302130B2

(12) United States Patent
Aho et al.

(10) Patent No.: US 9,302,130 B2
(45) Date of Patent: Apr. 5, 2016

(54) CONTROL OF THE ELECTRIC MOTORS OF A PUMP UNIT OF A FIRE PROTECTION SYSTEM

(75) Inventors: Markku Aho, Espoo (FI); Vesa Kettunen, Espoo (FI); Pasi Pennanen, Vantaa (FI)

(73) Assignee: MARIOFF CORPORATION OY (FI)

( * ) Notice: Subject to any disclaimer, the term of this patent is extended or adjusted under 35 U.S.C. 154(b) by 363 days.

(21) Appl. No.: 13/884,266

(22) PCT Filed: Oct. 21, 2011

(86) PCT No.: PCT/FI2011/050923

§ 371 (c)(1),
(2), (4) Date: May 8, 2013

(87) PCT Pub. No.: WO2012/062956

PCT Pub. Date: May 18, 2012

(65) Prior Publication Data

US 2013/0228345 A1 Sep. 5, 2013

(30) Foreign Application Priority Data

Nov. 8, 2010 (FI) ..... 20106174

(51) Int. Cl.
*A62C 35/68* (2006.01)
*A62C 99/00* (2010.01)
(Continued)

(52) U.S. Cl.
CPC ..... *A62C 35/68* (2013.01); *A62C 99/009* (2013.01); *F04B 17/03* (2013.01); *F04B 49/06* (2013.01);
(Continued)

(58) Field of Classification Search
CPC ..... F04B 49/00; F04B 49/02; F04B 49/022; F04B 49/06; F04B 49/08; F04B 49/10
USPC ..... 318/380, 799, 802; 417/3
See application file for complete search history.

(56) References Cited

U.S. PATENT DOCUMENTS 6,315,523 B1 * 11/2001 Mills ..... 417/45
2010/0012332 A1 * 1/2010 Fisher et al. ..... 169/24
(Continued)

FOREIGN PATENT DOCUMENTS

JP 5084322 4/1993
JP 10192440 7/1998
(Continued)

OTHER PUBLICATIONS

JP 2009008091 A—English Translation.*
(Continued)

*Primary Examiner* — Nathan J Newhouse
*Assistant Examiner* — Connor Tremarche
(74) *Attorney, Agent, or Firm* — Cantor Colburn LLP

(57) ABSTRACT

A fire protection system is provided including spray nozzles a pump unit, a control system with pressure-measuring mechanism, and piping for conducting extinguishing medium from the pump unit to the spray nozzles. The pump unit includes pump drives, each of which comprises a pump and an AC electric motor. The AC motor can be connected to an AC electricity network via a contactor device, in which pump unit the AC electric motors are controlled on the basis of the pressure measured in the piping. One of the electric motors is controlled by means of a frequency converter such that the motor steplessly adjusts pressure and the others are started up into the network as steplessly adjusting motors.

21 Claims, 7 Drawing Sheets

Figure 1:
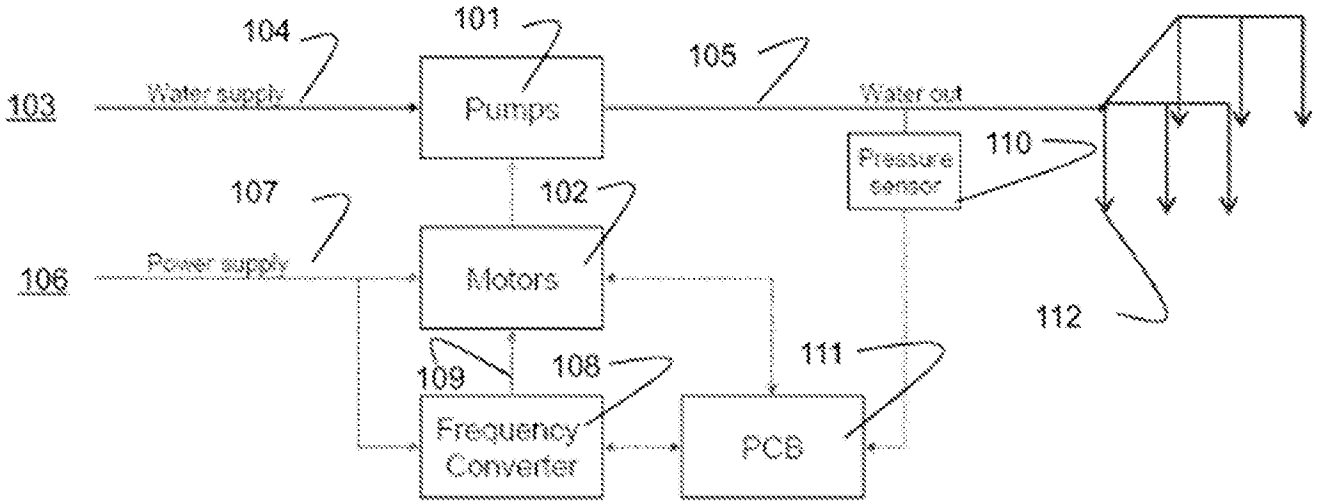

(51) Int. Cl.

| | |
|---|---|
| ***F04B 17/03*** | (2006.01) |
| ***F04B 49/06*** | (2006.01) |
| ***F04D 15/00*** | (2006.01) |
| ***F04D 15/02*** | (2006.01) |

(52) U.S. Cl.
CPC ..... *F04D 15/0066* (2013.01); *F04D 15/029* (2013.01); *F04D 15/0209* (2013.01); *F04B 2203/0202* (2013.01); *F04B 2203/0204* (2013.01); *F04B 2205/05* (2013.01)

(56) References Cited

U.S. PATENT DOCUMENTS

2013/0343911 A1* 12/2013 Stephens ..... F04B 49/00 417/44.1
2014/0271253 A1* 9/2014 Scheffer ..... A62C 35/68 417/53

FOREIGN PATENT DOCUMENTS

| | | | | |
|---|---|---|---|---|
| JP | 2008242333 | A | | 10/2008 |
| JP | 2009008091 | | | 1/2009 |
| JP | 2009008091 | A | * | 1/2009 |
| JP | 2010220907 | | | 10/2010 |
| RU | 2245183 | C2 | | 1/2005 |

OTHER PUBLICATIONS

Chinese Office Action, for application CN 201180053776, dated Dec. 3, 2014, 37 pages.
Russian Office Action for application PCT/FI2011/050923 dated Jun. 22, 2015, 4 pages.

* cited by examiner

CONTROL OF THE ELECTRIC MOTORS OF A PUMP UNIT OF A FIRE PROTECTION SYSTEM

CROSS-REFERENCE TO RELATED APPLICATIONS

This application is a U.S. National Stage application of PCT/FI2011/050923 filed Oct. 21, 2011, which claims priority to FI Application No. 20106174 filed Nov. 8, 2010, the entire disclosures of which are hereby incorporated herein by reference in their entireties.

FIELD OF THE INVENTION

The present invention relates to fire protection systems, and more particularly to high-pressure water mist extinguishing systems.

More particularly, the object of the present invention is a control method and control apparatus of the electric motors of a pump unit of a fire protection system, such as a water mist extinguishing system, more particularly a high-pressure water mist extinguishing system.

PRIOR ART

Nowadays pump units consisting of AC electric motors, power transmissions, high-pressure water pumps and unloading valves, with the purpose of these being to regulate the pressure in an activation situation, typically to a pressure of over 100 bar, e.g. to 140 bar-180 bar, are used in fire protection systems, such as in water mist extinguishing systems, more particularly in high-pressure water mist apparatuses. There is generally gearing between the high-pressure pumps and electric motors, in which gearing the power obtained from the shaft of an electric motor is divided between one or more high-pressure pumps such that the water yield required is obtained. Water is led to the high-pressure pumps from the unit's own water tank.

A high-pressure water mist extinguishing apparatus generally operates such that when the system is in standby mode a small pressure, e.g. 25 bar, is maintained e.g. with a pneumatic standby pump. In addition to a standby pump, the system can comprise a flow sensor disposed in a pressure-water pipe. If the temperature rises in a fire-protected space above the thermal value of the spray nozzles, the thermal ampoule in the nozzle breaks and lets water flow as mist into the protected space. The standby pump tries to keep 25 bar pressure in the piping and starts to pump more water into the piping, which brings about a flow of water. The flow sensor detects this flow and sends a signal, which brings about the starting of a pump unit.

The piping can also comprise a pressure switch monitoring the pressure. If the standby pump has failed and there is a flow in the piping, the flow sensor does not receive flow data. From this it follows that the signal of the flow sensor does not start the pump unit. If the pressure of the system falls in the piping below a preset limit value and stays below the limit for a certain time, this causes the starting of the pump by means of the pressure switch owing to the pressure being too low.

When the pump unit in prior-art pump units has started (activated), the electric motors of the pumps of the pump unit in turn start automatically directly to the electricity network under the control of a time relay with a short delay. If the required flow rate of the water is smaller than the yield of the pump unit, the excess part of the flow is conducted via unloading valves back into the water tank. High-pressure water pumps are typically rotated by means of three-phase AC electric motors connected to a three-phase AC electricity network.

A water tank, unloading valves and a separate standby pump are needed in prior-art pump units, which makes prior-art pump units relatively complex, large and expensive.

SUMMARY OF THE INVENTION

The purpose of this invention is to eliminate the drawbacks of prior art and to achieve an entirely new kind of method and apparatus to control the AC electric motors of a pump unit of a fire protection system, such as a water mist extinguishing system.

The solution according to the invention is based on a frequency converter, by means of which one of the motors is connected to the supply network. By means of the frequency converter variable voltage and variable frequency AC voltage can be obtained, with which one motor of the pump drive can be controlled.

In one embodiment of the invention the frequency converter is connected in a fixed manner to one of the AC electric motors.

In a second embodiment of the invention the frequency converter can be connected to any whatsoever of the AC electric motors of the pump drive.

The characteristic features of the method and the apparatus according to the invention are presented in detail in the independent claims 1 and 13. Preferred embodiments of the invention are presented in the other claims.

By means of the invention a very redundant control system for a pump unit, which control system gives added-value to the customer (including optimization of electricity consumption and water consumption as well as the possibility of minimizing the starting-current peaks of the electric motors), can be constructed cost-effectively.

In the pump unit according to the invention a separate water tank, unloading valves and a standby pump are not needed, which makes the pump units mechanically simple and compact. In addition, the problems caused by the typically large hysteresis of mechanical unloading valves and also by the warming of the water and the pumps caused by the circulation of the water can be avoided. Thus it has been possible to significantly simplify the mechanics of a pump unit compared to prior-art solutions.

In addition, only one frequency converter is needed in the apparatus, in parallel with which a second, standby frequency converter can be connected for ensuring operation, in which case the structure of the apparatus is also very simple in these respects. Additionally, the wearing of the motors and pumps can be balanced by changing the start-up sequence.

SHORT DESCRIPTION OF THE DRAWINGS

Figure 2:
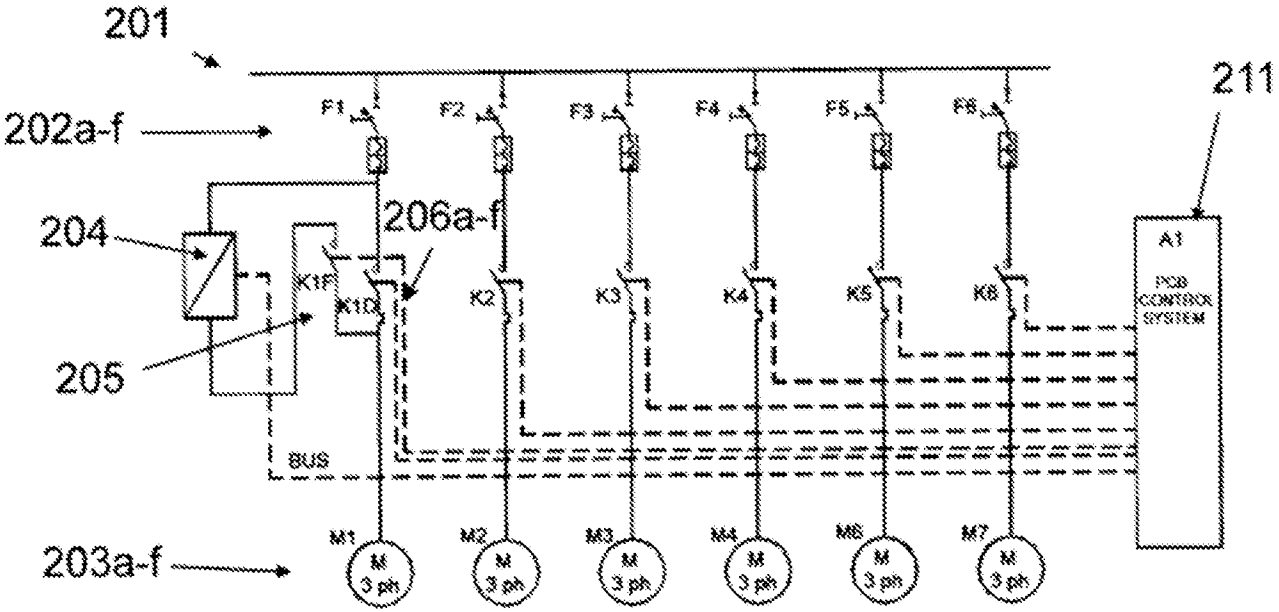
Figure 3:
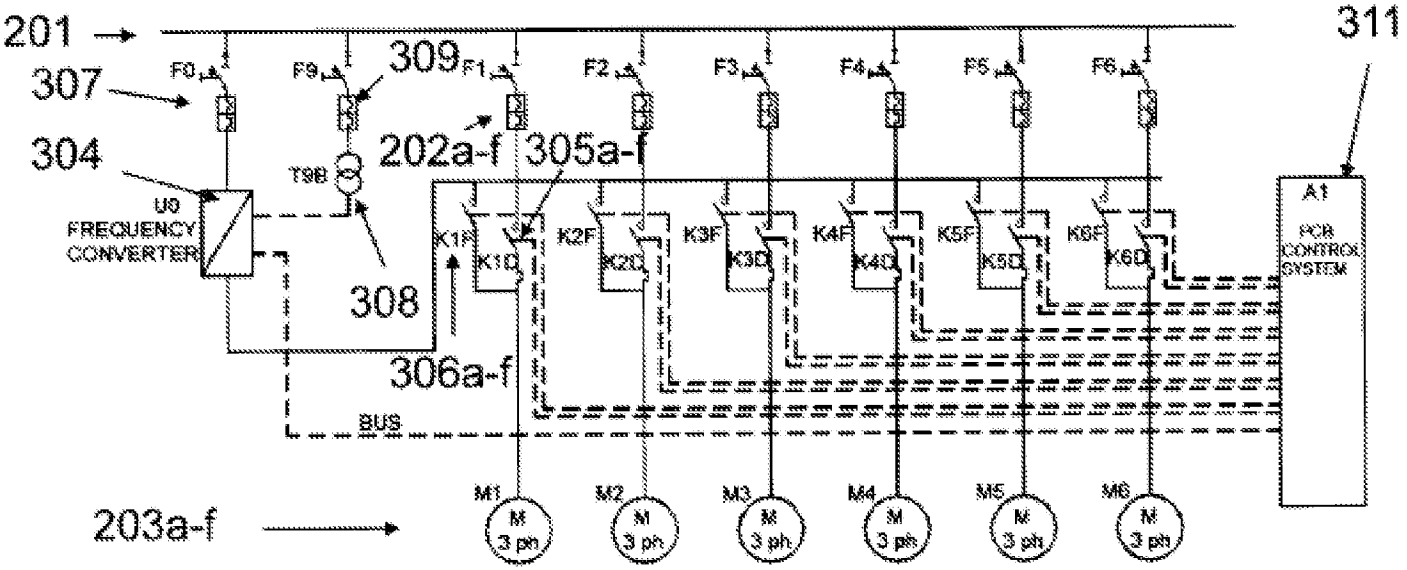
Figure 4:
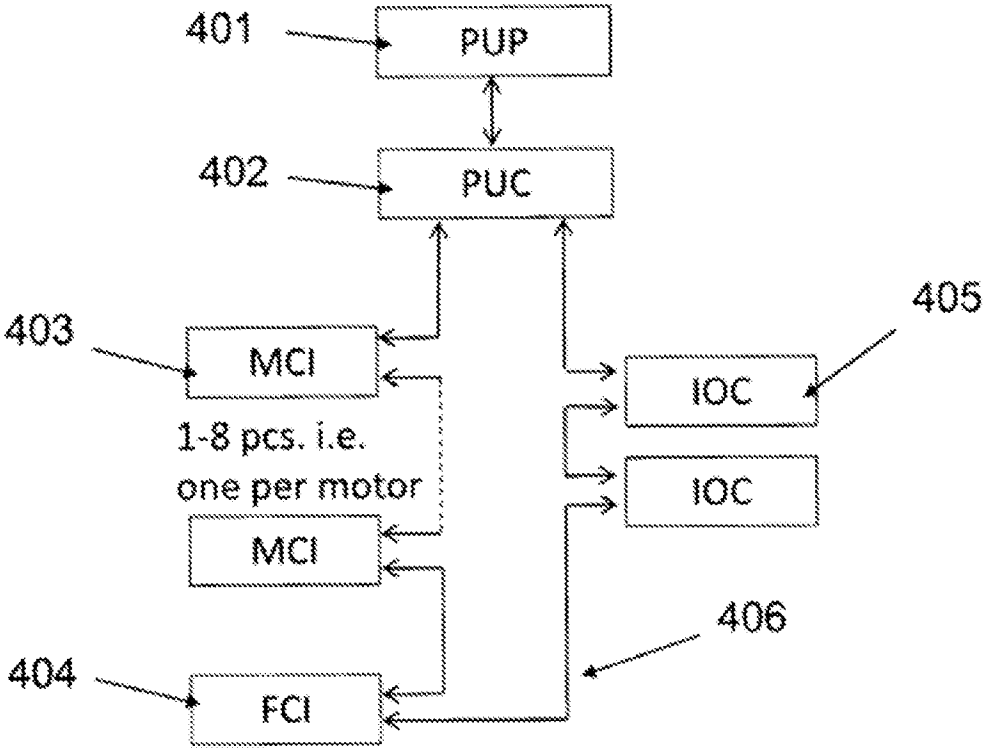
Figure 5:
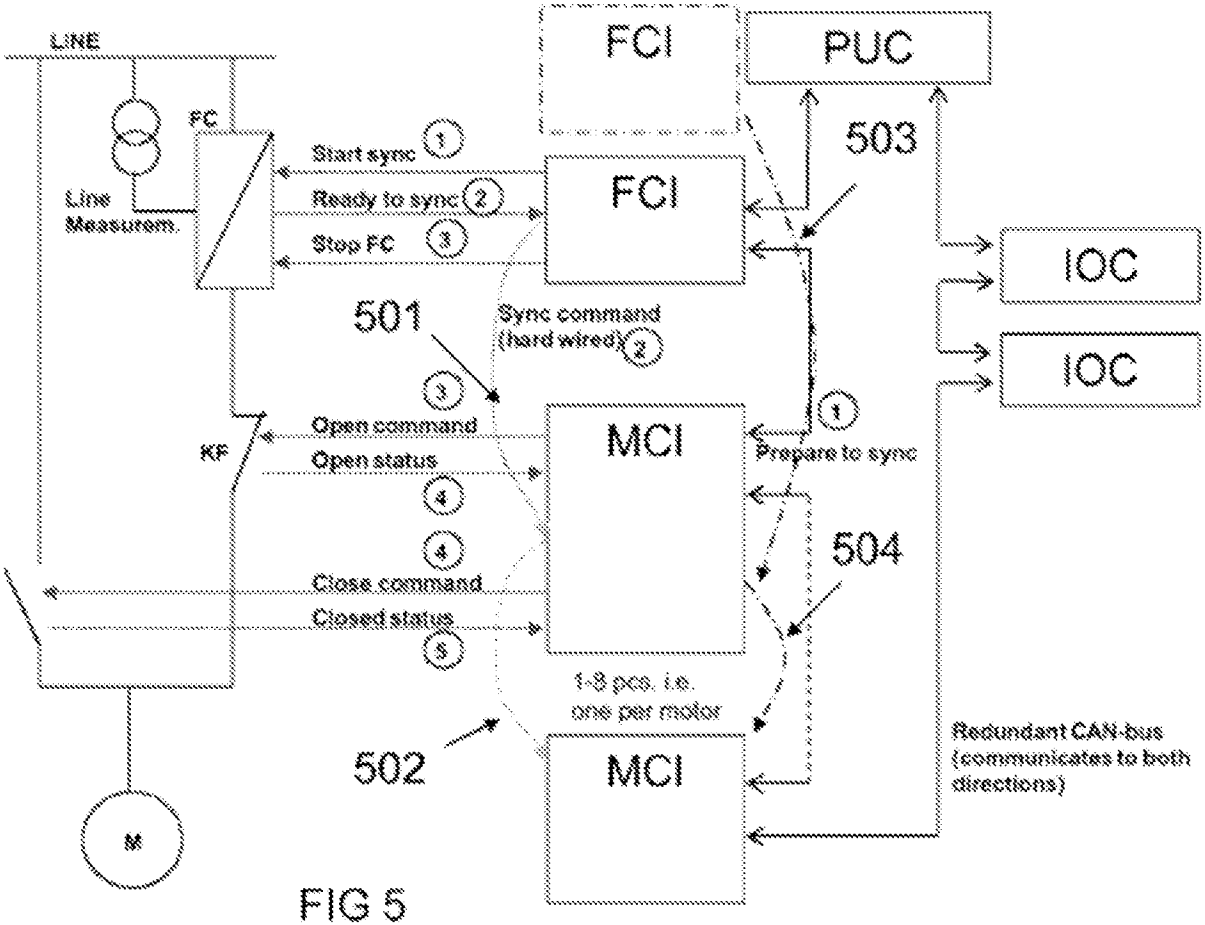
Figure 6:
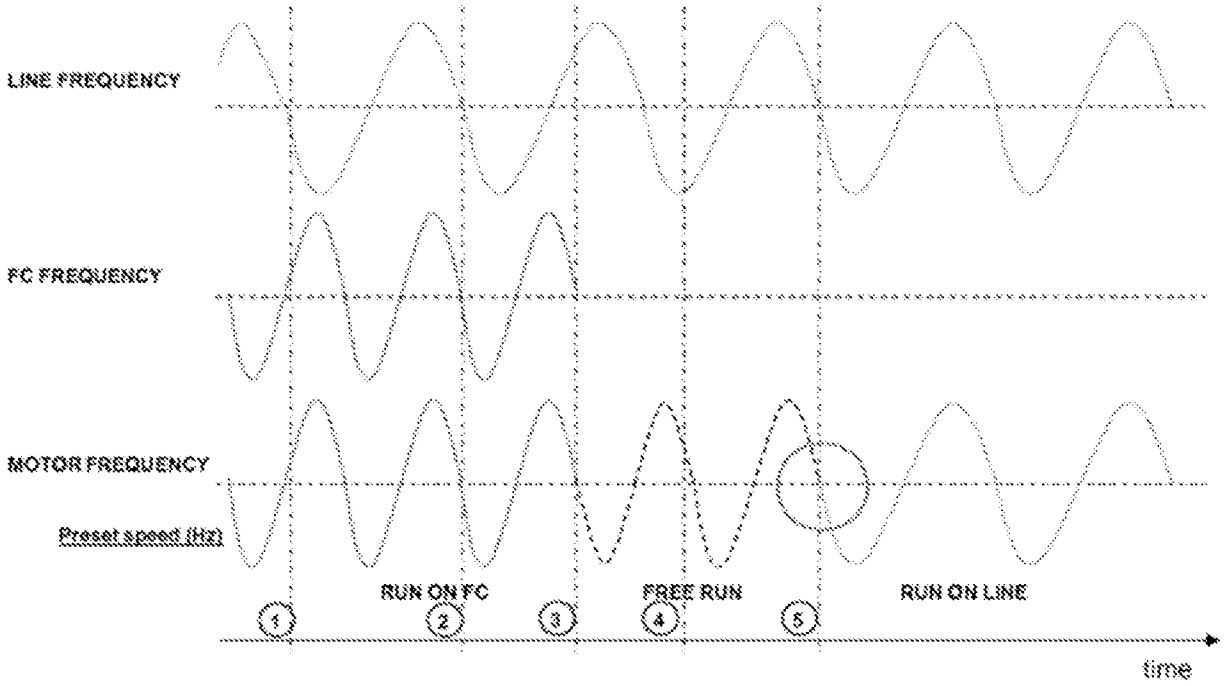

In the following, the invention will be described in more detail by the aid of an example of its embodiment with reference to the attached drawings, wherein FIG. 1 presents a simplified block diagram of the high-pressure water mist extinguishing system of the invention and the control apparatus of the pump unit of it with respect to one frequency-converter-controlled motor, FIG. 2 presents a wiring diagram of the motor circuit according to an embodiment of the invention, FIG. 3 presents a wiring diagram of the motor circuit according to a second embodiment of the invention, and FIG. 4 presents a block diagram of a control system according to the invention, FIG. 5 presents a block diagram of a second control system according to the invention, FIG. 6 presents the operation of the control system according to FIG. 5, and FIG. 7 also presents the operation of the control system according to FIG. 5.

DESCRIPTION OF PREFERRED EMBODIMENTS OF THE INVENTION

A fire protection system, such as a water mist extinguishing system, more particularly a high-pressure water mist extinguishing system, comprises spray heads that comprise spray nozzles and are disposed in a fire-protected space, a pump unit, and also piping with actuators for conducting extinguishing fluid from the pump unit to the spray nozzles. The pump unit comprises a number of pump drives, each of which comprises a high-pressure pump and an AC electric motor rotating it.

The system functions as presented in the above description of prior art, i.e. if the temperature rises in the fire-protected space above the thermal value of the spraying nozzles, the thermal ampoule in the nozzle breaks and lets water flow as mist into the protected space. In this invention the high-pressure pump functioning as the standby pump, which is controlled with a frequency converter, tries to keep 25 bar pressure in the piping and starts to pump more water into the piping, which brings about a flow of water. If the standby pumping is not sufficient to maintain the standby pressure in the preset time, the control system brings about the starting of a pump unit. The general structure and operation of a high-pressure water mist extinguishing system is obvious to a person skilled in the art and it is not essential from the viewpoint of the invention, so that it is not presented in the figures and it is not addressed in more detail in the following.

FIG. 1 presents a simplified block diagram of a high-pressure water mist extinguishing system according to the invention and the control apparatus of the electric motors of the pump unit thereof. The figure presents the high-pressure pumps 101 and the three-phase AC electric motors 102 rotating them. The water is conducted from the water mains system 103 by means of the supply piping 104 to the pumps and onwards by means of the second supply piping 105 to the spray nozzles 112, and electric power is supplied from the three-phase network 106 by means of three-phase supply cables 107 to the motors.

In the apparatus according to the invention one of the electric motors 102 is connected to the supply network via a frequency converter 108, in which case the motor in question can be controlled with variable frequency and variable amplitude three-phase AC voltage 109. The frequency converter can be e.g. a voltage-controlled PWM frequency converter, which comprises a rectifying bridge connected to the network, a DC intermediate circuit and an inverter bridge supplying the motor.

Pressure sensors (pressure transmitters) 110 are connected to the supply piping of the spray nozzles, and the sensors, like the motors and the frequency converter, are connected to a control unit (PCB) 111, with which the system is controlled. There are typically two pressure sensors, for the sake of redundancy, and in addition they can be connected to different IOC cards (see FIG. 4).

FIG. 2 describes the basic concept, at the main circuit level, wherein the frequency converter is connected in a fixed manner to one motor. The pump unit comprises six three-phase AC electric motors 203*a-f* connected via circuit-breakers (a fuse) 202*a-f* to a three-phase network 201. One of the motors is controlled with a frequency converter 204, which can be connected to the motor by means of a first contactor device 205, or otherwise the motor is supplied directly from the network via a second contactor device 206*a*, such that the motor can be connected to the network directly (KD contactors) or via the frequency converter (FC) (KF contactor). The other motors can be connected directly to the network via the contactors 206*b*-206*f*. The contactors are controlled by means of a separate electronic control unit (PCB Control System) 211.

When starting and operating the pump unit the motor being controlled with a frequency converter functions as a motor that steplessly "fine-tunes" the pressure and the others are started up directly into the network, i.e. to rated speed with "coarse adjustment", i.e. the required amount steplessly, to produce e.g. with a time delay the required flow rate of the water. In this way exactly the correct amount of pressure is produced with the pumps. Additionally, when the system is in standby mode a small pressure, e.g. 25 bar, is maintained in it by means of a frequency-converter-controlled motor instead of with a prior-art standby pump.

FIG. 3 describes an embodiment according to the invention, the so-called network synchronization concept, wherein pressure adjustment functions in exactly the same way as in the preceding, but a frequency converter 304 can be connected to any motor whatsoever. For this purpose each motor comprises two contactors, 305*a-f* (KD contactors) and 306*a-f* (FC contactors), all of which are connected to a separate electronic control unit 311. In addition, the frequency converter is connected to the network via its own circuit-breaker 307. Since the power requirement is often quite large, this concept is needed as the direct on-line starting current peaks of the motors could cause problems for the electricity network. The motors are synchronized to the frequency and phase of the main network, in which case they can be connected to it without significant current peaks. An instrument transformer 308 T9B is connected to the network via its own circuit-breaker 309 and, in addition, to an analog input of the frequency converter. The frequency converter is thus able to measure its own output voltage and the phase of the main network and to communicate the synchronization moment to the control electronics.

FIG. 4 describes the bus-controlled distributed control electronics of the control unit. The pump unit comprises a separate starter cubicle, common to all the motors and to the frequency converter, which cubicle is assembled from prefabricated modules, into which the control electronics of the control unit is distributed. The cubicle contains a user panel (PUP) 401 for the pump drive, said panel functioning as a user interface, a control unit card (controller) (PUC) 402 for the pump unit, connection boards (MCI) 403 for the motor control, a connection board (FCI) 404 for the frequency converter control, and input/output cards (IOC) 405. The control cards communicate along a redundant bidirectional CAN bus 406. For the sake of redundancy, two PUC cards and two FCI cards (i.e. also two frequency converters) can be connected to the system.

In the invention the system is controlled with synchronization of the network voltage (line synchronization), wherein the network voltage and the voltage of the motor are measured and the frequency of the motor is synchronized with the network frequency (see FIG. 6).

In order to gain the optimal benefit of line synchronization, the advance time needed for the operation of the contactor must be known. Furthermore, for simplifying the control this advance time should be the same for all the motors.

In a redundant CAN bus, there are many variables that make setting the advance time difficult; for example:

- the number of connection boards in the network, because each connection board typically causes a delay of approx. 1 ms on the route of the signal,
- command route; when there are problems in the connection, commands can travel either a longer or a shorter route.

In the invention this is solved with a control according to FIG. 5 such that the time-critical commands, which are a synchronization command, open the KF contactor, close the KD contactor, are generated locally in the FCI and in the MCI, and they do not need to be transferred backwards and forwards between them and the PUC.

In addition, the FCIs and the MCIs are connected galvanically with conductors 501-504 to each other via the synchronization connectors that they contain such that one conductor 501 leaves from the connection board of the frequency converter to the first connection board of the motor, and a second conductor 502 leaves from the first connection board of the motor to the connection board of a second motor, et cetera. Correspondingly the conductor 503, presented with dot-and-dash lines, can be connected from the synchronization connector of the second connection board of the frequency converter to the connection board of the motor and the motors further connected to each other with the conductor 504.

In the following, the operation of the apparatus will be described. In the description of operation, reference is made to FIGS. 6 and 7, in addition to FIG. 5, which figures describe the voltage U line of the network, the voltage UFC of the frequency converter, and the voltage UM of the motor on the time axis t (FIG. 6), as well as the synchronization start command (start sync) from the PUC, the KF control of the FC contactor, the KF status of the FC contactor, the control of the contactor KD connecting directly to the network and also the status of the contactor KD connecting directly to the network on the same time axis as the voltage of the motor (FIG. 7).

Figure 7:
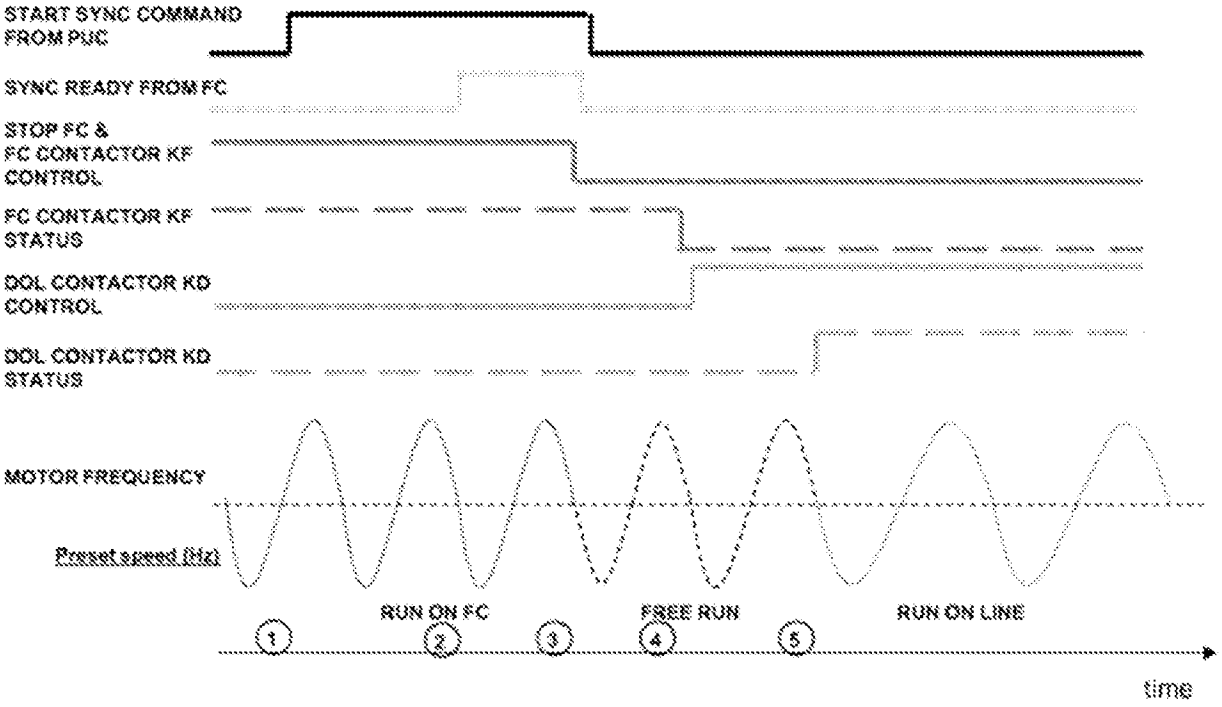

According to FIGS. 6 and 7, at the moment t1 a start command for synchronization is given from the PUC. In this case one of the motors, e.g. 203*a*, operates under frequency converter control. At the moment t2 the synchronization is completed and the synchronization ready command is given from the frequency converter. At the moment t3 a stop FC command and an open KF command are given. After that KF is opened at the moment t4 and a close KD command is given, and during the closing delay of the contactor KD the motor rotates freely until the moment t5, when KD is closed and the AC electric motor is connected directly to the network.

FIG. 7 further presents the connections of the contactors in the control in question. In the figure it is seen that the synchronization start command is on between t1-t3, the synchronization ready command is on between t2-t3, and the FC start command and the KF control of the FC contactor is on even before t1 up until the moment t3, in which case the FC contactor KF is closed during the opening delay until the moment t4. The control (DOL CONTACTOR KD CONTROL) of the contactor KD connecting directly to the network controls KD closed after the moment t4, and the contactor KD connecting directly to the network is closed until the moment t5 (DOL CONTACTOR KD STATUS).

FIG. 7 shows that the motor is controlled to a preset speed.

An ideal phase synchronization, in which no current peaks occur, is achieved when the synchronization and the connecting to the network occur when the voltage of the motor and the voltage of the network are in the same phase and at the zero point of the voltages in question at the moment t5 (FIG. 6).

A delay between the frequency of the voltage of FC and the phase synchronization, a delay to the opening of KF and a delay to the opening of KD is presented in FIG. 7 as time intervals t1-t2, t3-t4 and t4-t5. The preset advance is the time interval t2-t3.

It is obvious to the person skilled in the art that the different embodiments of the invention are not limited solely to the examples described above, but that they may be varied within the scope of the claims presented below. The characteristic features presented in the description mentioned in conjunction with other can also be independent characteristic features.

The invention claimed is:

1. Control method for the electric motors of a pump unit of a fire protection system, which fire protection system comprises spray nozzles (112), a pump unit, a control system with pressure-measuring mechanism, and piping (105) for conducting extinguishing medium from the pump unit to the spray nozzles, which pump unit comprises a plurality of pump drives, each of which comprises a pump (101) and an AC electric motor (102, 203*a*-203*f*) configured to rotate the pump, the AC electric motor being connected to an AC electricity network via a contactor device (206*a*-*f*), in which the AC electric motors are controlled on the basis of a pressure measured in the piping, characterized in that a first electric motor of the electric motors (102, 203*a*-203*f*) at a time is controlled by a frequency converter (108, 204) such that the first electric motor under the control of the frequency converter steplessly adjusts pressure and the others of the electric motors are started up into the AC electricity network as steplessly adjusting motors; and the pump unit is controlled via a separate control unit, common to the electric motors and to the frequency converter, the control unit comprises a control unit card (PUC) (402) for the pump unit, connection boards (MCI) (403) for the motor control, a connection board (FCI) (404) for frequency converter control, and input/output cards (IOC) (405), wherein time-critical commands, including a synchronization command, open the network directly (KF), close the frequency converter (KD), are generated locally in the connection boards (MCI) (403) for motor control, a connection board (FCI) (404) for frequency converter control.

2. Method according to claim 1, characterized in that the frequency converter can be connected to the first electric motor by means of a first contactor device (205), or otherwise the first electric motor is connected directly to the AC electricity network via a second contactor device (206*a*), such that the first electric motor can be connected to the network directly (KD) or via the frequency converter (KF).

3. Method according to claim 1, characterized in that the frequency converter is connected by means of a contactor device to the first electric motor.

4. Method according to claim 1, characterized in that the frequency converter can be connected by means of contactor devices to more than one of the electric motors of the pump drive.

5. Method according to claim 2, further comprising the first contactor device and the second contactor device (305*a*-*f* and 306*a*-*f*) for each electric motor, such that the frequency converter can be connected to each of the electric motors by means of the first contactor device (205), or otherwise each electric motor can be connected directly to the AC electricity network via the second contactor device (206*a*-206*f*), such that each electric motor can be connected to the network directly (KD) or via the frequency converter (KF).

6. Method according to claim 4, characterized in that the electric motors are synchronized to a frequency and phase of the AC electricity network, in which case they can be connected to it without significant current peaks.

7. Method according to claim 4, characterized in that an instrument transformer (308) is connected to an analog input of the frequency converter, and the frequency converter measures its own output voltage and the voltage of a phase of the AC electricity network and communicates a synchronization moment to the control electronics.

8. Method according to claim 1, characterized in that the fire protection system is a water mist extinguishing system, more particularly a high-pressure water mist extinguishing system.

9. Method according to claim 1, characterized in that the control unit card, the connection boards for motor control, the connection boards for frequency converter control, and the input/output cards communicate along a redundant bidirectional CAN bus (406).

10. Method according to claim 1, characterized in that the connection board for frequency converter control and the connection boards for motor control are connected galvanically with conductors (501-504) via synchronization connectors for giving synchronization commands from the connection board for frequency converter control to one of the connection boards for motor control.

11. Control apparatus of the electric motors of a pump unit of a fire protection system, which fire protection system comprises spray nozzles (112), a pump unit, a control system with pressure-measuring mechanism, and piping (105) for conducting extinguishing medium from the pump unit to the spray nozzles, which pump unit comprises a plurality of pump drives, each of which comprises a pump (101) and an AC electric motor (102, 203*a*-203*f*) configured to rotate the pump, the AC electric motor being connected to an AC electricity network via a contactor device (206*a-f*), and also a control unit, in which the AC electric motors of the pump unit are arranged to be controlled on the basis of a pressure measured in the piping, characterized in that the control apparatus comprises a frequency converter controlling one or more of the electric motors, and a the control unit is arranged to control a first one of the electric motors (102, 203*a*-203*f*) by means of a frequency converter (108, 204) such that the first electric motor under the control of the frequency converter steplessly adjusts pressure and the other electric motors are started up into the network as steplessly adjusting motors; and the pump unit is controlled via a separate control unit, common to the electric motors and to the frequency converter, the control unit comprises a control unit card (PUC) (402) for the pump unit, connection boards (MCI) (403) for the motor control, a connection board (FCI) (404) for frequency converter control, and input/output cards (IOC) (405), wherein time-critical commands, including a synchronization command, open the network directly (KF), close the frequency converter (KD), are generated locally in the connection boards (MCI) (403) for motor control, a connection board (FCI) (404) for frequency converter control.

12. Apparatus according to claim 11, characterized in that the frequency converter can be connected to the first electric motor by means of a first contactor device (205), or otherwise the first electric motor is coupled directly to the network via a second contactor device (206*a*), such that the first electric motor can be connected to the network directly (KD) or via the frequency converter (KF).

13. Apparatus according to claim 11, characterized in that the frequency converter is connected by means of a contactor device to one of the electric motors.

14. Apparatus according to claim 11, characterized in that the frequency converter can be connected by means of contactor devices to more than one of the electric motors of the pump drive.

15. Apparatus according to claim 12, characterized in that there is the first contactor device and the second contactor device (305*a-f* and 306*a-f*) for each electric motor, such that the frequency converter can be connected to each of the electric motors by means of the first contactor device (205), or otherwise each electric motor can be coupled directly to the network via the second contactor device (206*a*-206*f*), such that the electric motor can be connected to the network directly (KD) or via the frequency converter (KF).

16. Apparatus according to claim 14, characterized in that the electric motors can, by means of the control unit, be synchronized to a frequency and phase of the AC electricity network for connection without significant current peaks.

17. Apparatus according to claim 14, characterized in that an instrument transformer (308) is connected to an analog input of the frequency converter, and the frequency converter measures its own output voltage and a voltage of a phase of the AC electricity network and communicates a synchronization moment to the control unit.

18. Apparatus according to claim 11, characterized in that the fire protection system is a water mist extinguishing system, more particularly a high-pressure water mist extinguishing system.

19. Apparatus according to claim 11, characterized in that the control unit card, the connection boards for motor control, the connection boards for frequency converter control, and the input/output cards communicate along a redundant bidirectional CAN bus (406).

20. Apparatus according to claim 11, characterized in that the connection board for frequency converter control and the connection boards for motor control are connected galvanically with conductors (501-504) via synchronization connectors for giving synchronization commands from the connection board for frequency converter control to one of the connection boards for motor control.

21. Apparatus according to claim 11, characterized in that the apparatus comprises two frequency converters, connected in parallel, which are arranged to operate such that the first frequency converter operates in a normal operating situation, and the second frequency converter is fitted to operate when the first frequency converter fails.

* * * * *